US006186774B1

(12) United States Patent
Butera, Jr.

(10) Patent No.: US 6,186,774 B1
(45) Date of Patent: Feb. 13, 2001

(54) MODULAR BUTANE LIGHTER

(76) Inventor: Calogero Butera, Jr., 220 Potomac Ave., Buffalo, NY (US) 14213-1152

( * ) Notice: Under 35 U.S.C. 154(b), the term of this patent shall be extended for 0 days.

(21) Appl. No.: 09/419,481

(22) Filed: Oct. 15, 1999

(51) Int. Cl.[7] ..... F23Q 1/02

(52) U.S. Cl. ..... 431/277; 431/344; 431/143; 431/276; 431/273; 431/124

(58) Field of Search ..... 431/154, 276, 431/142, 344, 143, 255, 273, 277, 124, 144

(56) References Cited

U.S. PATENT DOCUMENTS

| | | | | |
|---|---|---|---|---|
| 2,166,881 | * | 7/1939 | Voss | 431/126 |
| 2,529,094 | * | 11/1950 | Miller | 431/344 |
| 2,556,853 | * | 6/1951 | Shanks | 431/277 |
| 2,592,837 | * | 4/1952 | Wedemeyer | 431/126 |
| 2,611,202 | * | 9/1952 | Lipic | 431/344 |
| 2,618,952 | * | 11/1952 | Peterson et al. | 431/344 |
| 2,680,962 | * | 6/1954 | Lipic et al. | 431/277 |
| 2,697,339 | * | 12/1954 | Reich | 431/142 |
| 3,277,674 | * | 10/1966 | Klein et al. | 431/344 |
| 3,414,364 | * | 12/1968 | Bert | 431/143 |
| 3,498,734 | | 3/1970 | Retzler | 431/142 |
| 3,620,015 | | 11/1971 | Hocq | 60/52 |
| 3,709,655 | | 1/1973 | Beijering | 431/344 |
| 3,820,941 | * | 6/1974 | Piffath et al. | 431/344 |
| 3,884,616 | | 5/1975 | Neyret | 431/142 |
| 3,884,618 | | 5/1975 | Neyret | 431/254 |
| 3,895,904 | | 7/1975 | Kimball | 431/143 |
| 3,938,942 | | 2/1976 | Torassa | 431/142 |
| 3,963,413 | * | 6/1976 | Lockwood et al. | 431/344 |
| 4,295,819 | | 10/1981 | Sugiyama | 431/143 |
| 4,884,965 | * | 12/1989 | Nitta | 431/277 |
| 5,387,101 | | 2/1995 | Chan | 431/153 |
| 5,487,657 | | 1/1996 | Fairbanks et al. | 431/153 |

OTHER PUBLICATIONS

Photograph of Colibri Lighter.

* cited by examiner

*Primary Examiner*—Ira S. Lazarus
*Assistant Examiner*—David Lee
(74) *Attorney, Agent, or Firm*—Hodgson Russ Andrews Woods & Goodyear LLP

(57) ABSTRACT

A lighter assembly especially suitable for burning butane gas as a fuel is provided in modular form which consists essentially of two unitary subassemblies which may be detachably mounted together to form the assembled lighter. The lighter assembly, which features low cost and structural simplicity, is constructed with the first subassembly comprising a hollow body defining a chamber for storing the fuel, an inlet valve assembly for inserting fuel into said chamber, a burner valve assembly for controlling emission of the fuel from said chamber, and a burner valve actuating arm for opening and closing the burner valve. The second subassembly, which is configured to form a cover member for the first subassembly, comprises an integrally formed body portion having operatively mounted thereupon a spark mechanism including a flint for igniting the fuel as it is emitted from the burner assembly, and a manually operable spring-loaded actuator button for engaging the actuating arm to effect opening of the burner valve assembly. Means are provided for detachably mounting the first and second subassemblies together for operation of the lighter and for enabling manual detachment thereof for refueling and reflinting the lighter.

8 Claims, 4 Drawing Sheets

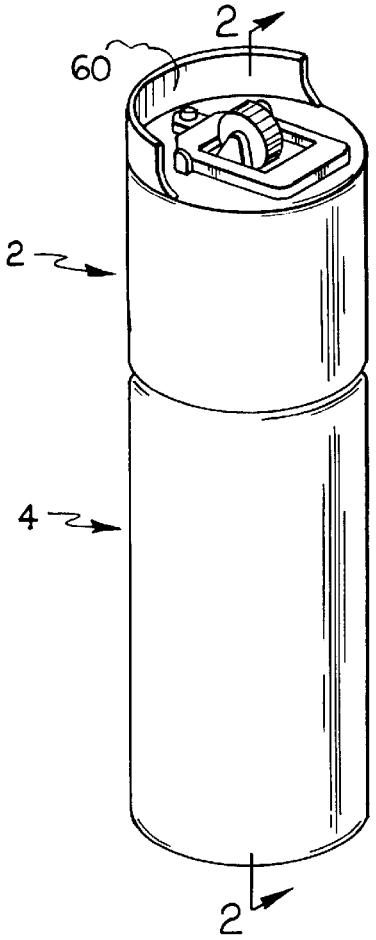
FIG. 1
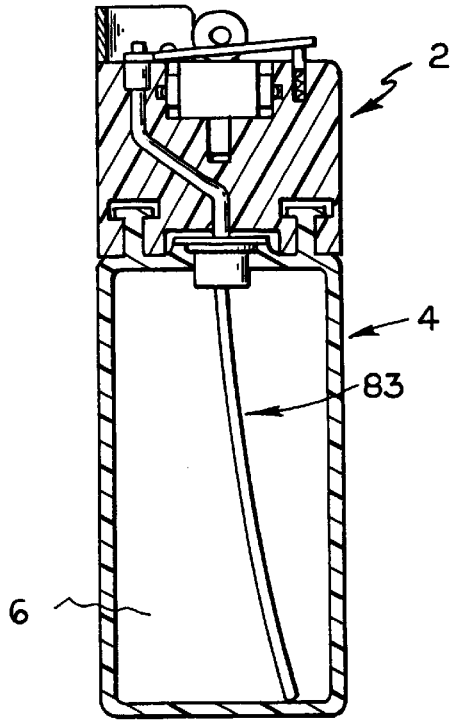
FIG. 2
FIG. 5
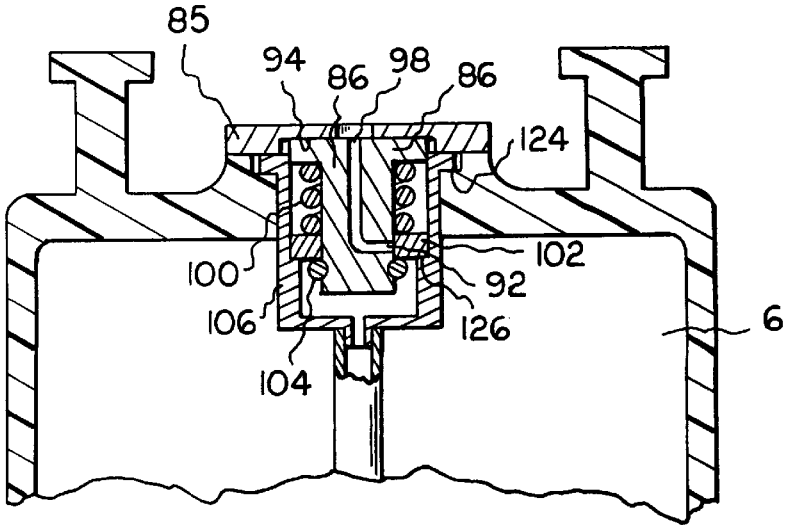

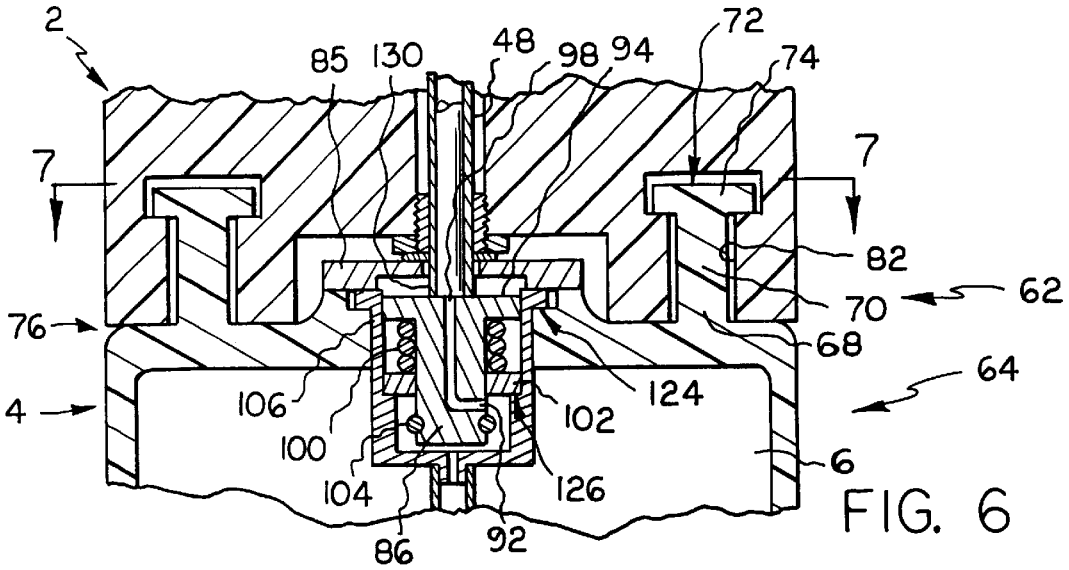
FIG. 6
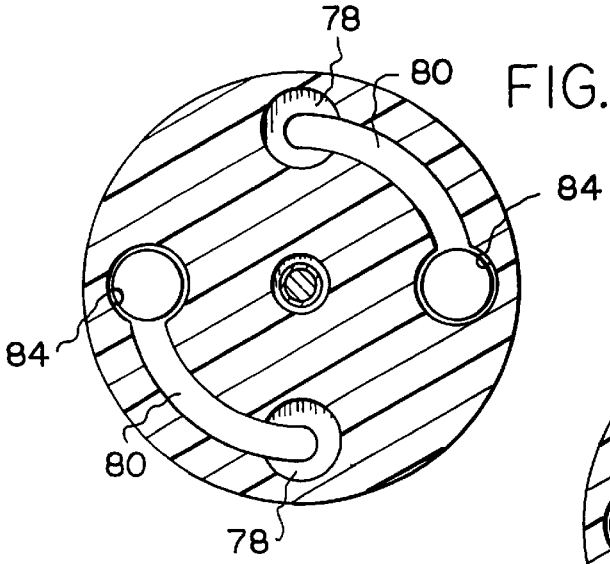
FIG. 7
FIG. 8
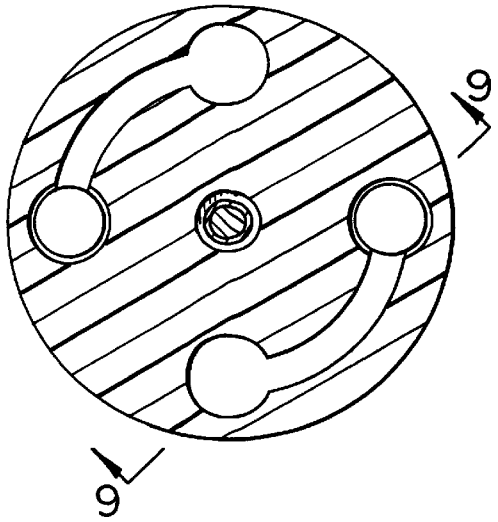
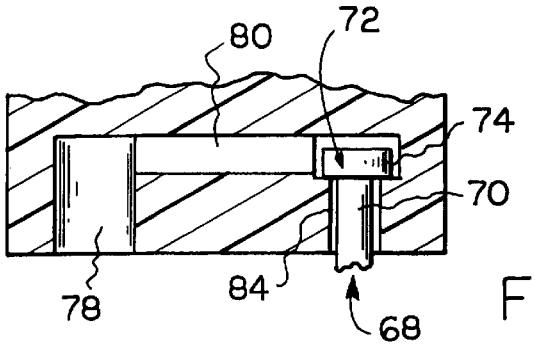
FIG. 9

MODULAR BUTANE LIGHTER

BACKGROUND OF THE INVENTION

1. Field of Invention

The present invention pertains to lighters and more particularly to gas lighters in which the ignition device is quickly removable from a disposable fuel reservoir.

2. Prior Art

Modern gas lighters are presently in use for such tasks as lighting cigars and cigarettes, and starting fires. The vast majority of gas lighters are designed to have a very limited useful life. These gas lighters become useless once the reservoir of fuel, typically butane has been expended, and are disposed of by the user, and replaced with a completely new lighter. These typical lighters also have a limited supply of flint or other similar material, which is used to generate a spark to ignite the fuel. Presently, gas lighters are designed with full knowledge that the lighter will be disposed of, and oftentimes, there is still useful flint in the lighter which is wastefully disposed of as well. However, for lighters which are expensive, or have other significant meaning to the user, such as a the lighter being a gift or a collectible, it is very desirable to keep the lighter and replace the fuel and flint when they have been expended.

There are presently several known methods for accomplishing the replacement of fuel and flint in a gas lighters which are not designed to be disposed of when empty. These are lighters which call for the use of numerous valves for the refueling process. U.S. Pat. No. 3,895,904 to Kimball shows a modular type gas lighter which calls for the use of numerous valves to refuel the reservoir. The device shows two subassemblies to be detached to perform the refueling ritual. The user is required to perform the task of bringing a butane supply source to the reservoir and matably engaging the reservoir inlet valve with the butane supply source. Not only is this a time consuming process, but a very dangerous process as well, for if the inlet valve is unclean or fails, the flammable butane is uncontrollably released into the atmosphere.

U.S. Pat. No. 3,938,942 to Torassa discloses a pyrophoric gas lighter comprising a head which slips over the hollow stem of a replacement can. The lighter head is attached to the fuel container solely by sliding the lighter head onto the operating step of the fuel replacement can. The invention is unable to withstand routine handling as the lighter head and the replacement can are easily detachable. Furthermore, this device is potentially dangerous, as all the loads applied to this lighter, via routine handling and use, are directly imparted on the valve stem of the pressurized container. This valve stem will undoubtedly fatigue with time, use and handling, causing all the fuel to be released in one uncontrolled hazardous event.

U.S. Pat. No. 4,295,819 to Sugiyama discloses a gas lighter wherein a container filled with a gas evolving liquid is detachably attached to one side of the lighter body. The lighter body has on its upper portion an ignition device comprising a flint and an ignition file, and a member which is made to engage and disengage the nozzle of the bomb. The fuel container can unexpectedly detach from the lighter, as it is not securely locked in contact with the lighter body. Also, the device lacks the ability to replace the ignition means if it becomes worn or otherwise inoperable.

SUMMARY OF THE INVENTION

The present invention has been accomplished to overcome all of the deficiencies and disadvantages above mentioned.

It is an object of this invention to provide a completely modular lighter which is assembled from a fuel reservoir, an ignition module, a flint, a lighter frame, all of which are detachable from one another.

It is a further object of this invention to provide a removable ignition module such that if the flint is depleted or the ignition module becomes worn due to usage and needs replacing, this can be simply and quickly accomplished by replacing the flint or the entire ignition module.

It is yet another object of this invention to provide a replaceable fuel reservoir that locks in place with the lighter frame, such that the processes of refueling the lighter from a fuel reservoir is unnecessary, and the fuel reservoir is locked in place such that it can only be removed by the intentional act of the user.

The present invention avoids the problems and hazards associated with prior lighters. The present invention allows for the replacement of any portion of the lighter. There is also inherent safety with the present invention, as the user is not required to do the physical task of refilling the fuel reservoir, and the problems associated with unclean or inoperative inlet valves used in prior lighters is eliminated. Furthermore, the user does not need to keep a fuel supply on hand, which oftentimes becomes a hazard in itself as it ages.

Briefly, the present invention may be described as a completely modular lighter assembly. The lighter has an upper assembly, a lower assembly, a lighter frame, an ignition module, and a mechanism to releasably attach the upper assembly to the lower assembly.

The upper assembly is constructed from a lighter frame and an ignition module detachably attached to the lighter frame. The ignition module makes use of a movable sphere movably urged into a hollow in the upper assembly. This permits the entire ignition module to be removed from the upper assembly for purposes of replacing the assembly or replacing the flint in the assembly. Of course, the flint is utilized in the ignition module and is contacted by a striker to produce sparks and ignite the fuel.

The entire upper assembly is detachably connected to the lower assembly. The lower assembly is equipped with at least one mating member which is attached at one end to the lower assembly and has a pressure plate attached to the other end. The upper assembly is provided with a hollowed out portion having the following characteristics. There is an insertion end, a raceway, a groove, and a terminal end. The pressure plate and mating member are inserted into the insertion end and the upper assembly and lower assembly are rotated in opposite directions, until the mating member and pressure plate are at the terminal end. At this point the upper assembly and lower assembly are locked in place. Of course, applying forces in the opposite of the aforesaid will release the assemblies.

The lower assembly is provided with a fuel reservoir. The lower assembly is discarded when empty. The lower assembly is equipped with a fuel transfer mechanism that prevents fuel from being released when the upper and lower assemblies are not attached, and allows the flow of gas or fuel when the upper and lower assemblies are attached. This transfer mechanism is a pressure sensitive valve that includes a plunger, a spring, a collar, a rubber ring, a reducer, and a cap. The entire assembly is placed into the lower assembly's receiving hole. The spring is placed about the plunger, then the collar and rubber ring are placed about the plunger. The plunger is then placed into the receiving hole and is held in place by the cap which is secured to the lower assembly. The cap has a hole, and the plunger assembly has a hole having an entrance portion and an exit portion. The plunger is movable between two positions. The first position is an inactive position where the upper assembly and the lower assembly are apart. In this position, fuel is not permitted to leave the lower assembly, as the entrance portion of the hole in the plunger is effectively blocked by the collar, and the seal between the plunger and the collar is sealed by the rubber ring.

The second position is an active position in which the fuel is permitted to escape the lower assembly. This position is achieved when the lower assembly is connected to the upper assembly. The upper assembly is provided with a plunger forcing post. This post fits through the hole in the cap and forces downwardly on the plunger, and compresses the biasing means. As a result, the entrance portion of the plunger hole is no longer sealed by the collar and rubber ring. In the active position, fuel is permitted to flow from the fuel reservoir by passing through the hole in the plunger, through the hole in the cap, and through the fuel conduit provided in the upper assembly to the fuel spout valve.

To operate the lighter, the lower assembly is attached to the upper assembly, thus allowing fuel to escape the fuel reservoir. The user generates a spark from the ignition module, and pushes down on the fuel lever, the fuel lever activates the fuel spout valve, and releases fuel to a location outside the lighter, in a location occupied by sparks. A combustion flame is created, and continues to exist until the fuel reservoir empties, or the user releases the fuel lever. The present invention will now be set forth more fully in the following drawings and detailed description.

DESCRIPTION OF THE DRAWINGS

FIG. 1 is a perspective view of the invention as it appears when assembled.

FIG. 2 is a cross-sectional view of the lighter taken along line 2—2 shown in FIG. 1.

FIG. 5 is a cross-sectional view of the plunger valve assembly when the valve is in the inactive position.

FIG. 6 is a cross-sectional view of the plunger valve assembly when the plunger valve is activated by connecting the upper and lower assemblies.

FIG. 7 is a sectional view taken along line 7—7 shown in FIG. 6.

FIG. 8 is a sectional view taken along line 8—8 shown in FIG. 6.

FIG. 9 is a view taken along line 9—9 shown in FIG. 8.

DETAILED DESCRIPTION OF THE INVENTION

Figure 3:
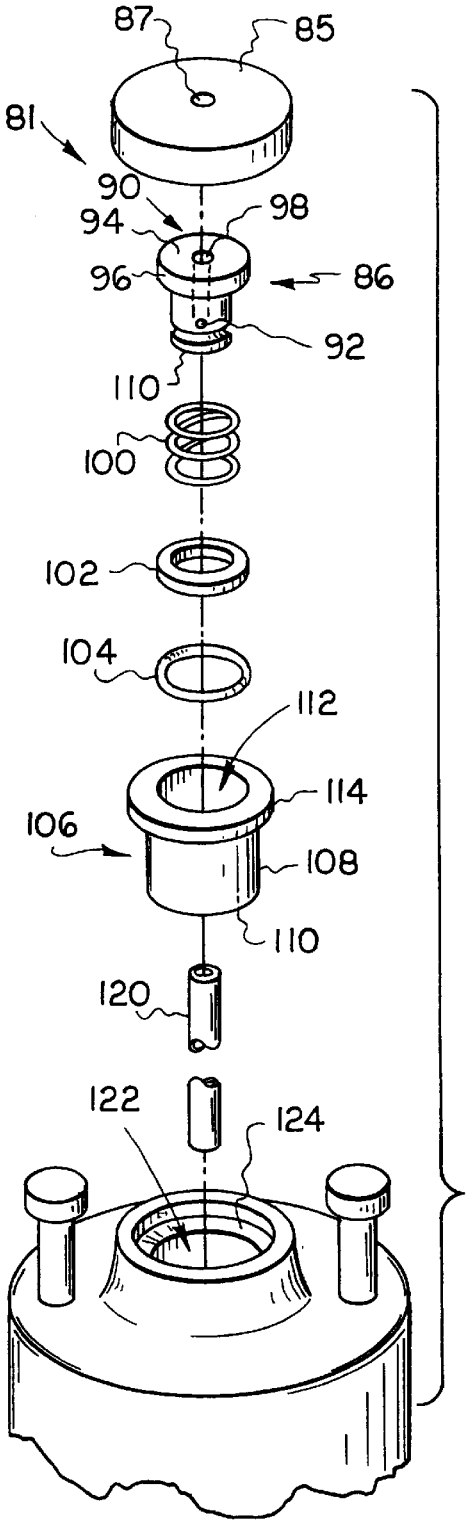
FIG. 3 is an exploded top view of the constituent parts of the plunger valve assembly.
Figure 4:
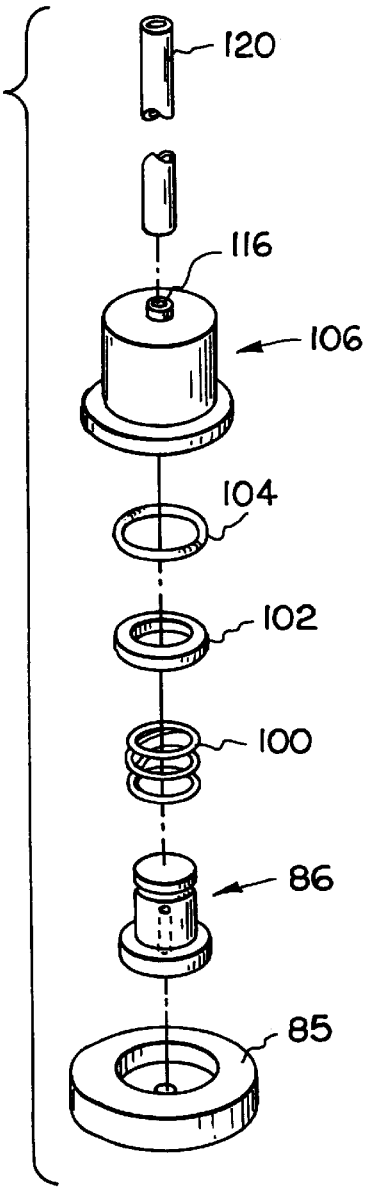
FIG. 4 is an exploded bottom view of the constituent parts of the plunger valve assembly.

In FIG. 1 is shown the modular cigarette lighter as it appears in its assembled state. It is important to point out that although the lighter is cylindrical in shape, other shapes such as rectangular, triangular and the like are also covered within the ambit of this invention. FIG. 1 also shows wind-shield 60, which prevents the flame from being extinguished in windy environments.

FIG. 2 and FIG. 6 both show cross-sectional views of the lighter, and the upper assembly 2 and the lower assembly 4. Reference number 6 shows the fuel reservoir to be used to store a fuel for burning. This fuel is preferably butane, but can be any fuel which is capable of being expelled from the fuel reservoir 6, such as aerosols and the like.

Figure 10:
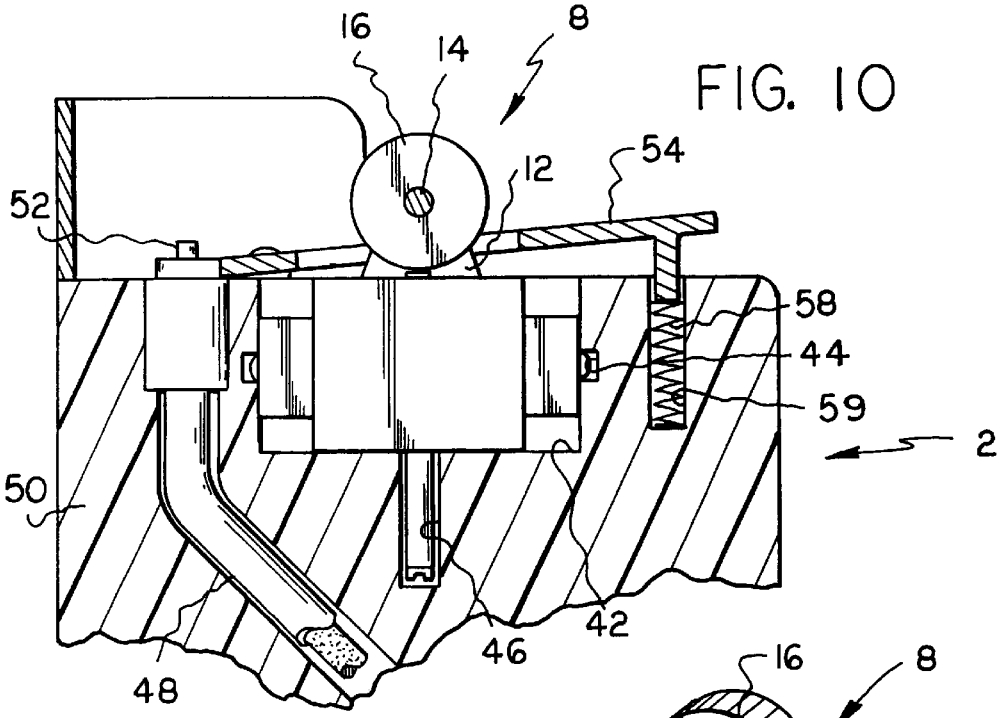
FIG. 10 is a partial cutaway side view of the top of the lighter.
Figure 11:
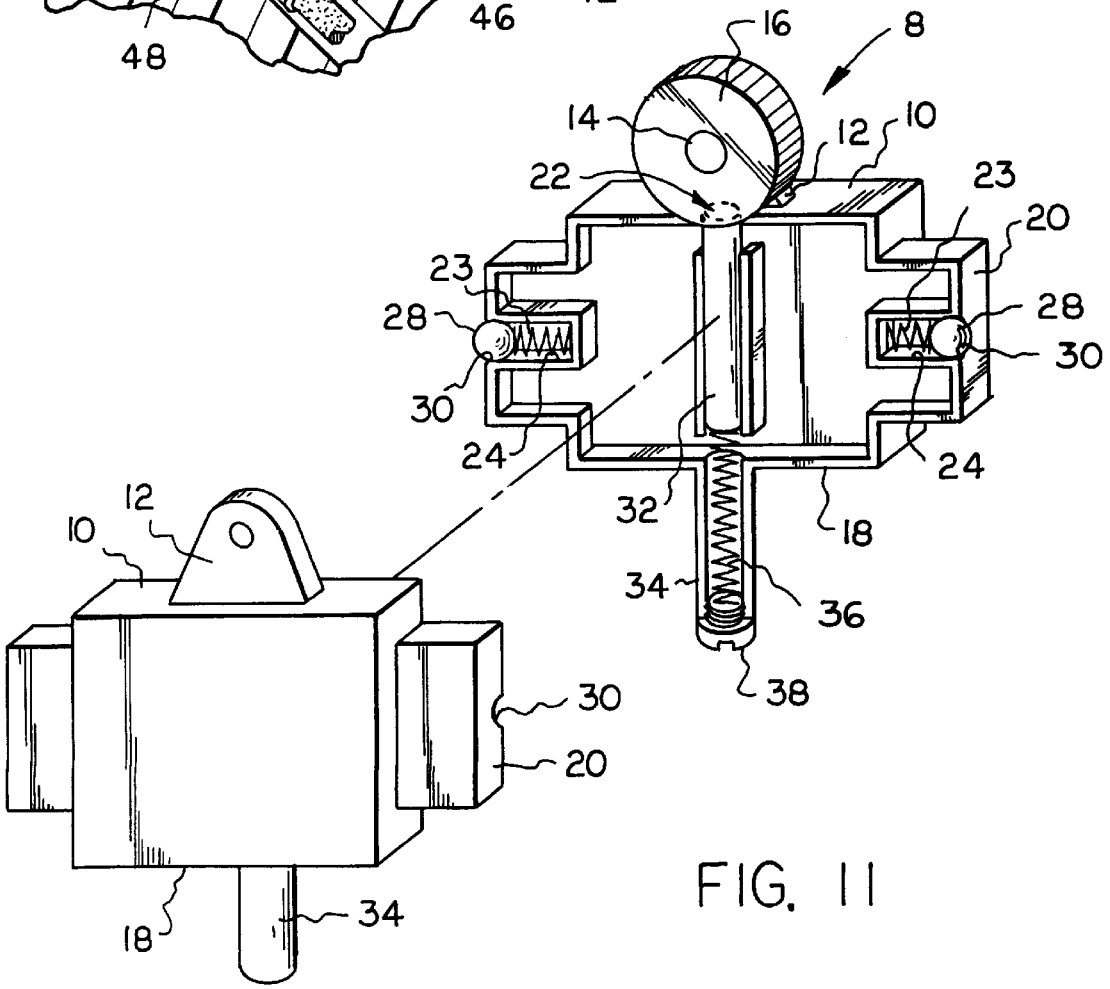
FIG. 11 is an exploded view of the ignition module.

FIG. 10 and FIG. 11 show the ignition module 8. Ignition module 8 has a top cover 10, to which is attached a striker 16, supported by striker support 12, and connected to the striker support by pin 14. Ignition module 8 also has bottom cover 18 and side wall 20 interposed between top cover 10 and bottom cover 18. Top cover 10 and bottom cover 18 define a first hole 22 which passes completely through ignition module 8. The sidewall 20 defines a second hole 24, which does not pass through the ignition module 8. A first spring 23 is inserted into second hole 24. A durable sphere 28 is located in second hole 24, and a lip 30 is formed around hole 24. Lip 30 prevents the durable sphere 28 from exiting the hole and durable sphere 28 extends partially beyond side wall 20. The first spring 23 permits the durable sphere 28 to move from positions completely in hole 24, to positions outside of sidewall 20. The durable sphere can be made from metal, plastic, glass, or any similar type of material.

FIG. 11 also shows flint 32, flint extension 34, second spring 36, and restraining mechanism 38. Flint 32 is placed in first hole 22, such that it contacts striker 16. The second spring 36 is positioned in first hole 32 between the flint 32, restraining mechanism 38, and flint extension 34, for accommodating the spring and flint. In this setup, second spring 36 forces the flint 32 to contact the striker 16. Restraining mechanism 38 can be removed and can be something as simple as a screw threadably fastened to the flint extension 34. It is important to point out that flint extension 34 need not be present in the invention, so long as there is sufficient room in the first hole 22 to accommodate the flint 32 and second biasing means 36. In that case, of course, restraining member 38 would be attached directly to bottom cover 18.

FIG. 10 shows the placement of the ignition module 8 in upper assembly 2. Upper assembly 2 has cavity 42 formed in it, hollow 44 formed in it, and flint receiving hole 46 formed in it. This upper assembly 2 shows lighter frame 50. The upper assembly also has gas or fuel conduit 48 passing through it, the gas or fuel conduit to supply fuel valve 52. Fuel valve 52 is opened, which permits fuel to exit to a location outside the lighter, when fuel lever 54 is depressed and opens fuel valve 52. This arrangement is known in the prior art and will not be set forth in greater detail. Fuel spring 58, located in fuel spring hole 59, keeps fuel valve 52 closed until the fuel lever 54 is depressed by the user, the user of course compressing fuel spring 58 in the process of using the lighter.

The ignition module 8 is removed from upper assembly 2 for purposes of replacing the flint 32 or replacing the entire ignition module 8. This is accomplished by forcibly pulling the ignition module 8 from upper assembly 2. Ignition module 8 is held in place in the upper assembly 2, by means of the durable sphere occupying hollow 44 when entire ignition module 8 is placed in cavity 42. Also, when in this position, flint extension 34 is accommodated by flint hole 46. Durable sphere 28, of course, is held in hollow 44 due to the force of first biasing spring 23. The user simply pulls on ignition module 8, and this causes durable sphere 28 to compress first spring 26, which further causes durable sphere 28 to fully retract into second hole 24. When the ignition module 8 is fully removed from cavity 42, the durable sphere 28 once again extends partially outside of side wall 20. To place the ignition module 8 back into upper assembly 2, the reverse process is performed, and durable sphere 28 returns to its terminal position in which it is partially in second hole 22 and partially in hollow 44, locking the ignition module in place. The ignition module 8 may also comprise an electric ignition module such as a piezo-electric type.

FIGS. 6–9 all show the interlocking mechanism 76. Arrow 62 shows the bottom portion of upper assembly 2 and arrow 64 shows the top portion of lower assembly 4. Mating member 70 is attached at first end 68 to the top portion 64. Mating member 70 has attached to its second end 72, pressure plate 74. Bottom portion 62 of upper assembly 2 has an accommodating region 76 which includes insertion end 78, passageway 80, raceway 82, and terminal end 84. The upper assembly 2 and lower assembly 4 are attached when mating member 70 and pressure plate 74 are moved into insertion end 78, and then the pressure plate is moved through passageway 80 and mating member 70 is moved through raceway 82, until the mating member 70 and pressure plate 74 occupy the terminal end 84. In this location, the upper assembly 2 and lower assembly 4 are interlocked. To replace lower assembly 4 and fuel reservoir 6, the upper assembly 2 and lower assembly 4 are slightly compressed together, then rotated in opposite directions and separated. The action necessary to remove the fuel supply is comparable to the action required to open a child-proof cap. It is important to note that although the drawing depicts two mating members and associated pressure plates, the invention can function properly with one mating member 70 and pressure plate 74.

FIGS. 3–6 all show views of the plunger valve assembly 81 and fuel transfer mechanism 83. Plunger valve assembly 80 includes cap 85 having axial cap hole 87. The plunger 86 has a top 94 and a bottom 110, and cylindrical side walls 98. Plunger hole 98 has exit portion 90 and entrance portion 92. Rim 96 is located at top 94. Plunger valve assembly 81 also includes spring 100, collar 102, and rubber ring 104. The 30 spring 100, collar 102 and rubber ring 104 are all placed around cylindrical side wall 98. The plunger valve assembly is inserted into reducer 106, the reducer 106 has first reducer hole 112, stopping lip 114, sidewalls 108, bottom 110, and second reducer hole 116. The lower assembly 4 has receiving hole 122 and pressure plate stopper 124 and second pressure plate stopper 126. The plunger is movable from an inactive position in FIG. 5 to an active position in FIG. 6. The plunger 86, spring 100, collar 102 and rubber ring 104 are inserted into the first reducing hole 112 of the reducer 106. The cap 85 is fixed to the lower assembly 4, and contains the plunger 86 and reducer 106. In the inactive position, the collar 102 is forced against the second stopping plate 126, and the entrance portion 92 of plunger hole 88 is sealed by a combination of the collar 102 and rubber ring 104, as shown in FIG. 5. In the inactive position, no fuel is permitted to exit the fuel reservoir 6. The plunger valve assembly 81 is activated when the interlocking mechanism 76 connects the upper assembly 2 to the lower assembly 4. FIG. 6 shows the active position of the plunger valve. In this position, the plunger forcing post 130 pushes downward on the plunger top 94, which in turn compresses spring 100, and moves the entrance portion 92 of the plunger hole 88, such that the entrance portion 92 is no longer sealed by collar 102. This allows fuel to move from the fuel reservoir 6, through the plunger hole 88, through the axial cap hole 87 and through fuel conduit 48. Fuel conduit 48 can be of any suitable porous material, and rubber ring 104 can be of any similar type plastic or resin material. The fuel is then available for use in association with fuel valve 52 and the fuel lever 54.

Hence, the present invention allows for a replaceable ignition module 8, flints 32, and entire lower assemblies containing fuel 4, 6. The user never as to fumble with dangerous canisters or compressed butane to refill the fuel reservoir 6. Accordingly, the disadvantages and problems of the prior art are overcome with the present invention.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

I claim:

1. A modular lighter comprising:

an upper assembly, a lower assembly capable of releasably interlocking with the upper assembly, said lower assembly defining a fuel reservoir for storing fuel;

an ignition module, the ignition module releasably attached to the upper assembly, the ignition module capable of igniting the fuel;

a fuel transfer mechanism interposed between the lower assembly and upper assembly, the fuel transfer mechanism capable of transferring fuel from the fuel reservoir to a destination outside the upper assembly, for ignition by the ignition module, the fuel transfer mechanism including a valve disposed on the lower assembly, the valve responsive to the connecting and disconnecting of the upper and lower assembly such that, when the upper and lower assemblies are connected, the valve opens so that fuel is allowed to pass through the fuel transfer mechanism from the fuel reservoir to the upper assembly and when the upper and lower assemblies are disconnected, the valve closes;

a mating member capable of interlocking the upper assembly and the lower assembly;

a pressure plate attached to the mating member and having a larger cross-sectional area than the mating member;

a passageway and a raceway connection insertion portion to a terminal portion, the insection portion sized to receive the pressure plate and the mating member;

the passageway sized to accommodate the pressure plate as it moves from the insertion portion to the terminal portion;

the raceway sized to accommodate the mating member as it moves from the insertion portion to the terminal portion;

the terminal portion sized to receive the pressure plate and mating member such that the upper assembly and lower assembly are interlocked.

2. The modular lighter according to claim 1 wherein the ignition module comprises:

a top cover;

a bottom cover;

side walls interposed between the top cover and the bottom cover, defining a hole through the ignition module, the hole having a first opening on the top cover and a second opening on the bottom cover;

a flint disposed in the hole;

a striker movably attached to the top cover and positioned above the first opening;

a spring disposed in the opening and capable of biasing the flint toward the first opening;

means for restraining the spring, the restraining means attached to the bottom cover and positioned in the second opening, the spring interposed between the restraining means and the flint, the flint interposed between the spring and the striker and forcibly urged against the striker by the spring.

3. The modular lighter according to claim 1, wherein the fuel transfer mechanism comprises:

a cap defining an axial cap hole;

a plunger having a top and a cylindrical side wall attached to the top, the plunger defining a plunger hole, the plunger hole having an entrance portion defined on the cylindrical side wall and an axial exit portion defined on the top;

a spring disposed around the plunger;

a collar disposed around the plunger;

a rubber ring disposed in a groove on the plunger;

a reducer capable of receiving the plunger and defining an axial reducer hole; and, a tubular opening connecting the entrance portion and the axial exit portion.

4. The modular butane lighter of claim 1 further comprising:

the upper assembly having internal side walls defining a cavity, at least one of the side walls defining a hollow; and, the ignition module having a top cover and a bottom cover, and a locking wall interposed between the top cover and the bottom cover, the locking wall defining a hole having a bottom, a lip partially covering the hole, a spring disposed between the bottom of the hole and a durable sphere and exerting pressure against the durable sphere, the lip for preventing the escape of the durable sphere from the hole such that the durable sphere extends partially outside the locking wall, the cavity capable of receiving the ignition module, and the hollow capable of receiving the durable sphere for detachably locking the ignition module to the upper assembly.

5. A lighter comprising:

a body defining a fuel reservoir for holding fuel, said body including a fuel supply means for supplying fuel to be ignited outside of said body;

a head including means for igniting the fuel;

interlocking means for detachably connecting said body to said head such that fuel is delivered from said fuel reservoir to said fuel ignition means while said body and said head are interconnected, wherein said interlocking means comprises a cover portion affixed to said body, a base portion affixed to said head, said cover portion including means for interconnecting with said base portion, said base portion including means for interconnecting with said cover portion, wherein said means for interconnecting with said cover portion comprises at least one locking pin formed as an integral part of said cover portion, and said means for interconnecting with said base portion includes locking pin receiving means formed as an integral part of said base portion.

6. A modular lighter comprising:

an upper assembly, a lower assembly capable of releasably interlocking with the upper assembly, said lower assembly defining a fuel reservoir for storing fuel;

an ignition module, the ignition module releasably attached to the upper assembly, the ignition module capable of igniting the fuel;

a fuel transfer mechanism interposed between the lower assembly and upper assembly, the fuel transfer mechanism capable of transferring fuel from the fuel reservoir to a destination outside the upper assembly, for ignition by the ignition module;

a bottom portion affixed to one end of the upper assembly;

a top portion affixed to one end of the lower assembly;

a mating member having a first end and a second end, the first end of the mating member connected to the top portion of the lower assembly;

a pressure plate, the pressure plate attached to the second end of the mating member, the pressure plate of larger cross-sectional area area than the mating member;

the bottom portion of the upper assembly defining a passageway, a raceway, an insertion portion, and a terminal portion, the insertion portion for receiving the pressure plate and mating member, the passageway for accommodating the pressure plate as it moves from the insertion portion to the terminal portion, the raceway for accommodating the mating member as it moves from the insertion portion to the terminal portion, and the terminal portion for receiving the pressure plate and mating member for locking the upper assembly and lower assembly in place.

7. A modular lighter comprising:

an upper assembly, a lower assembly capable of releasably interlocking with the upper assembly, said lower assembly defining a fuel reservoir for storing fuel;

an ignition module, the ignition module releasably attached to the upper assembly, the ignition module capable of igniting the fuel;

a fuel transfer mechanism interposed between the lower assembly and upper assembly, the fuel transfer mechanism capable of transferring fuel from the fuel reservoir to a destination outside the upper assembly, for ignition by the ignition module, the fuel transfer mechanism having a cap defining an axial cap hole; a plunger having a top and a cylindrical side wall attached to the top, the plunger defining a plunger hole, the plunger hole having an entrance portion defined on the cylindrical side wall and an axial exit portion defined on the top;

a spring disposed around the plunger;

a collar disposed around the plunger;

a rubber ring disposed in a groove on the plunger;

a reducers capable of receiving the plunger and defining an axial reducer hole; and, a tubular opening connecting the entrance portion and the axial exit portion.

8. A modular lighter comprising:

an upper assembly, a lower assembly capable of releasably interlocking with the upper assembly, said lower assembly defining a fuel reservoir for storing fuel;

an ignition module, the ignition module releasably attached to the upper assembly, the ignition module capable of igniting the fuel;

a fuel transfer mechanism interposed between the lower assembly and upper assembly, the fuel transfer mechanism capable of transferring fuel from the fuel reservoir to a destination outside the upper assembly, for ignition by the ignition module, the upper assembly having internal side walls defining a cavity, at least one of the side walls defining a hollow; and, the ignition module having a top cover and a bottom cover, and a locking wall interposed between the top cover and the bottom cover, the locking wall defining a hole having a bottom, a lip partially covering the hole, a spring disposed between the bottom of the hole and a durable sphere and exerting pressure against the durable sphere, the lip for preventing the escape of the durable sphere from the hole such that the durable sphere extends partially outside the locking wall, the cavity capable of receiving the ignition module, and the hollow capable of receiving the durable sphere for detachably locking the ignition module to the upper assembly.

* * * * *

UNITED STATES PATENT AND TRADEMARK OFFICE

CERTIFICATE OF CORRECTION

PATENT NO. : 6,186,774

DATED : Feb. 13, 2001

INVENTOR(S) : Butera, Jr.

It is certified that error appears in the above-identified patent and that said Letters Patent is hereby corrected as shown below:

Col. 8, line 35 - "reducers" should be -- reducer --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*